US008555861B2

(12) United States Patent
Tokuda

(10) Patent No.: US 8,555,861 B2
(45) Date of Patent: Oct. 15, 2013

(54) FUEL PUMP APPARATUS

(75) Inventor: Yoshihito Tokuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 238 days.

(21) Appl. No.: 13/047,585

(22) Filed: Mar. 14, 2011

(65) Prior Publication Data

US 2011/0226358 A1 Sep. 22, 2011

(30) Foreign Application Priority Data

Mar. 17, 2010 (JP) ..... 2010-060877

(51) Int. Cl.
*F02M 37/22* (2006.01)

(52) U.S. Cl.
USPC ..... 123/506; 123/509; 137/565.17; 137/549; 210/453

(58) Field of Classification Search
USPC ..... 123/506, 509, 514; 137/563, 549
See application file for complete search history.

(56) References Cited

U.S. PATENT DOCUMENTS

| | | | | |
|---|---|---|---|---|
| 5,520,156 | A * | 5/1996 | Brunnhofer | 123/516 |
| 7,363,917 | B2 * | 4/2008 | Kramer et al. | 123/511 |
| 8,240,332 | B1 * | 8/2012 | Matusek et al. | 137/565.17 |
| 2008/0210203 | A1 * | 9/2008 | Sugiyama | 123/509 |

FOREIGN PATENT DOCUMENTS

| | | |
|---|---|---|
| JP | 2006-182154 A | 7/2006 |
| JP | 2008-213630 A | 9/2008 |

OTHER PUBLICATIONS

JP 2006-182154 Machine Translation.*

* cited by examiner

*Primary Examiner* — John Rivell
*Assistant Examiner* — Angelisa Hicks
(74) *Attorney, Agent, or Firm* — Birch, Stewart, Kolasch & Birch, LLP

(57) ABSTRACT

A fuel pump apparatus for supplying fuel to an engine includes a lid member is formed divisionally from a first lid member having a fuel supply path, and a second lid member removably provided on the first lid member and having a fuel inflow path. A fuel filter is disposed between the first lid member and the second lid member. Since the fuel filter is built in the lid member, a protective case for protecting the fuel filter and a stay for attaching the fuel filter to a vehicle body are not required. The fuel pump apparatus so configured eliminates the requirement for a protective case for protecting a fuel filter and an attaching stay for attaching the fuel filter to a vehicle body and can achieve reduction of the cost.

19 Claims, 10 Drawing Sheets

FUEL PUMP APPARATUS

CROSS-REFERENCE TO RELATED APPLICATION

The present application claims priority under 35 U.S.C. §119 to Japanese Patent Application No. 2010-060877, filed Mar. 17, 2010, the entire contents of which are hereby incorporated by reference.

BACKGROUND OF THE INVENTION

1. Field of the Invention

This invention relates to a fuel pump apparatus which sucks fuel from a fuel tank and pressurizes and supplies the fuel to an engine.

2. Description of Background Art

As a technique for supplying fuel to an intake system of an engine, a technique of pressurizing fuel from a fuel tank by means of a pump and feeding the pressurized fuel to an engine has been placed into practical use (refer to, for example, Japanese Patent Laid-Open No. 2008-213630 (FIG. 5(b)).

As shown in FIG. 5(b) of Japanese Patent Laid-Open No. 2008-213630, a fuel pump apparatus (81) (reference character in parentheses represents a reference character used in Japanese Patent Laid-Open No. 2008-213630. This similarly applies also to the following description) includes a pump (86), a pump pre-filter (87) provided at an intake port of the pump (86) for removing foreign matter included in fuel, a tube member (83) for accommodating the pump (86) and the pump pre-filter (87) therein, and a lid member (82) for closing up an upper opening of the tube member (83). The lid member (82) includes a joint portion (82*c*) serving as an inlet port for fuel from within a fuel tank, and a joint portion (82*a*) serving as an outlet port of fuel to an intake system of an engine.

Incidentally, if the fuel pump apparatus (81) is mounted on a vehicle represented by an off road bike which travels on an unpaved road, then foreign matter such as sand is sometimes mixed into fuel. Although the mixed foreign matter is caught by the pump pre-filter (87), if the amount of foreign matter becomes great, then the pump pre-filter (87) is clogged, and this drops the pump flow rate.

A countermeasure for preventing the pump flow rate from dropping has been proposed (refer to, for example, Japanese Patent Laid-Open No. 2006-182154 (FIGS. 2 and 4)).

As shown in FIG. 2 of Japanese Patent Laid-Open No. 2006-182154, in a fuel pump apparatus (10) (numeral in parentheses represents a reference character used in Japanese Patent Laid-Open No. 2006-182154. This similarly applies also to the following description), a lid member (11) is removably attached to a tube member (12) in which a pump (13) and a pump pre-filter (18) are accommodated. Since the lid member (11) is removably attached, the pump pre-filter (18) can be taken out by removing the lid member (11).

By taking out, cleaning and returning the pump pre-filter (18), a drop of the pump flow rate can be prevented.

However, in the technique illustrated in FIG. 2 of Japanese Patent Laid-Open No. 2006-182154, when the pump pre-filter (18) is to be taken out, it is necessary to pull out the lid member (11), pump (13) and accessories in their entirety from the tube member (12) and carry out working, and therefore, the maintenance performance is not high.

A technique which eliminates the requirement for taking out of the pump pre-filter (18) is shown in FIG. 4 of Japanese Patent Laid-Open No. 2006-182154.

As shown in FIG. 4 of Japanese Patent Laid-Open No. 2006-182154, a fuel filter (41) is interposed midway of a fuel hose (32) which connects a fuel tank (40) and the fuel pump apparatus (10) to each other. Since foreign matter in fuel is removed by the fuel filter (41), clogging of the pump pre-filter can be prevented. With this structure, there is no requirement for taking out of the pump pre-filter.

In other words, by removing the exposed fuel filter (41) from the fuel hose (32), exchange and cleaning can be carried out, and improvement of the maintenance performance can be anticipated.

However, in the technique disclosed in FIG. 4 of Japanese Patent Laid-Open No. 2006-182154, since the fuel filter (41) is exposed to the outside, a protective case for the purpose of a countermeasure against a flying stone is required. In addition, a stay for attaching the fuel filter to a vehicle body is required separately.

Therefore, a technique which does not require a protective case for protecting a fuel filter or a stay for attaching a fuel filter to a vehicle body is demanded.

SUMMARY AND OBJECTS OF THE INVENTION

It is an object of the present invention to provide a fuel pump apparatus which eliminates the requirement for a protective case for protecting a fuel filter and a stay for attaching the fuel filter to a vehicle body and can achieve reduction of the cost.

According to an embodiment of the present invention, a fuel pump apparatus which includes:

a pump, a tube member for accommodating the pump, and a lid member for closing up an upper opening of the tube member and wherein:

fuel supplied from a fuel tank and reserved in the tube member is sucked into and pressurized by the pump and supplied to an engine, wherein:

the lid member includes a fuel inflow path for introducing the fuel from the fuel tank into the tube member and a fuel supply path for supplying the fuel pressurized by the pump to the engine, and that;

a fuel filter for removing foreign matter included in the fuel from the fuel tank is removably provided for the fuel supply path.

According to an embodiment of the present invention, the fuel pump apparatus is characterized in that the lid member is formed divisionally from a first lid member attached to the tube member and having the fuel supply path, and a second lid member removably provided on the first lid member and having the fuel inflow path, and that the fuel filter is disposed between the first lid member and the second lid member.

According to an embodiment of the present invention, the fuel pump apparatus is characterized in that the first lid member includes a position restraining member provided thereon for restraining movement of the fuel filter in a direction perpendicular to an axial direction thereof.

According to an embodiment of the present invention, the fuel pump apparatus is characterized in that the position restraining member is molded integrally with the first lid member.

According to an embodiment of the present invention, the fuel pump apparatus is characterized in that a pressing member for restraining movement of the fuel filter in the axial direction is interposed between the second lid member and the fuel filter.

The effects of the invention included the following:

In the present invention, the fuel filter for removing foreign matter included in fuel from the fuel tank is removably provided for the lid member. In other words, the fuel filter is built in the lid member.

Since the fuel filter is built in the lid member, the fuel filter is protected by the lid member. Since the fuel filter is built in the lid member, the fuel filter is supported by the lid member and the requirement for a stay for exclusive use is eliminated.

Since the present invention eliminates the requirement for a protective case and a stay in comparison with the existing structure which requires a protective case and a stay because a fuel tank and a fuel pump apparatus are connected to each other by a fuel hose and a fuel filter is interposed midway of the fuel hose, the number of parts can be reduced to achieve reduction of the cost.

In the present invention, the lid member is formed divisionally from the first lid member attached to the tube member and the second lid member removably provided on the first lid member, and the fuel filter is disposed between the first lid member and the second lid member.

Since the fuel filter is disposed between the first lid member and the second lid member, upon exchange of the fuel filter, there is no requirement for removal of the first lid member from the tube member and only it is required to remove the second lid member. Therefore, exchange of the fuel filter is facilitated.

In the present invention, the first lid member includes a position restraining member provided thereon for restraining movement of the fuel filter in the direction perpendicular to the axial direction thereof thereby to prevent positional displacement of the fuel filter.

The fuel filter is positioned at the predetermined place of the first lid member by the position restraining member. Since the fuel filter is positioned, the second lid member can be attached readily. As a result, exchange of the fuel filter is facilitated.

In the present invention, the position restraining member is molded integrally with the first lid member.

Since the position restraining member is molded integrally with the first lid member, there is no requirement for new addition of a part for position restraint, and reduction of the number of parts can be anticipated.

In the present invention, the pressing member for restraining movement of the fuel filter in the axial direction to press the fuel filter against the first lid member is interposed between the second lid member and the fuel filter.

Since the fuel filter is pressed against the first lid member by the pressing member, the fuel filter is held with certainty between the first lid member and the second lid member. Therefore, vibration of the fuel filter can be suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
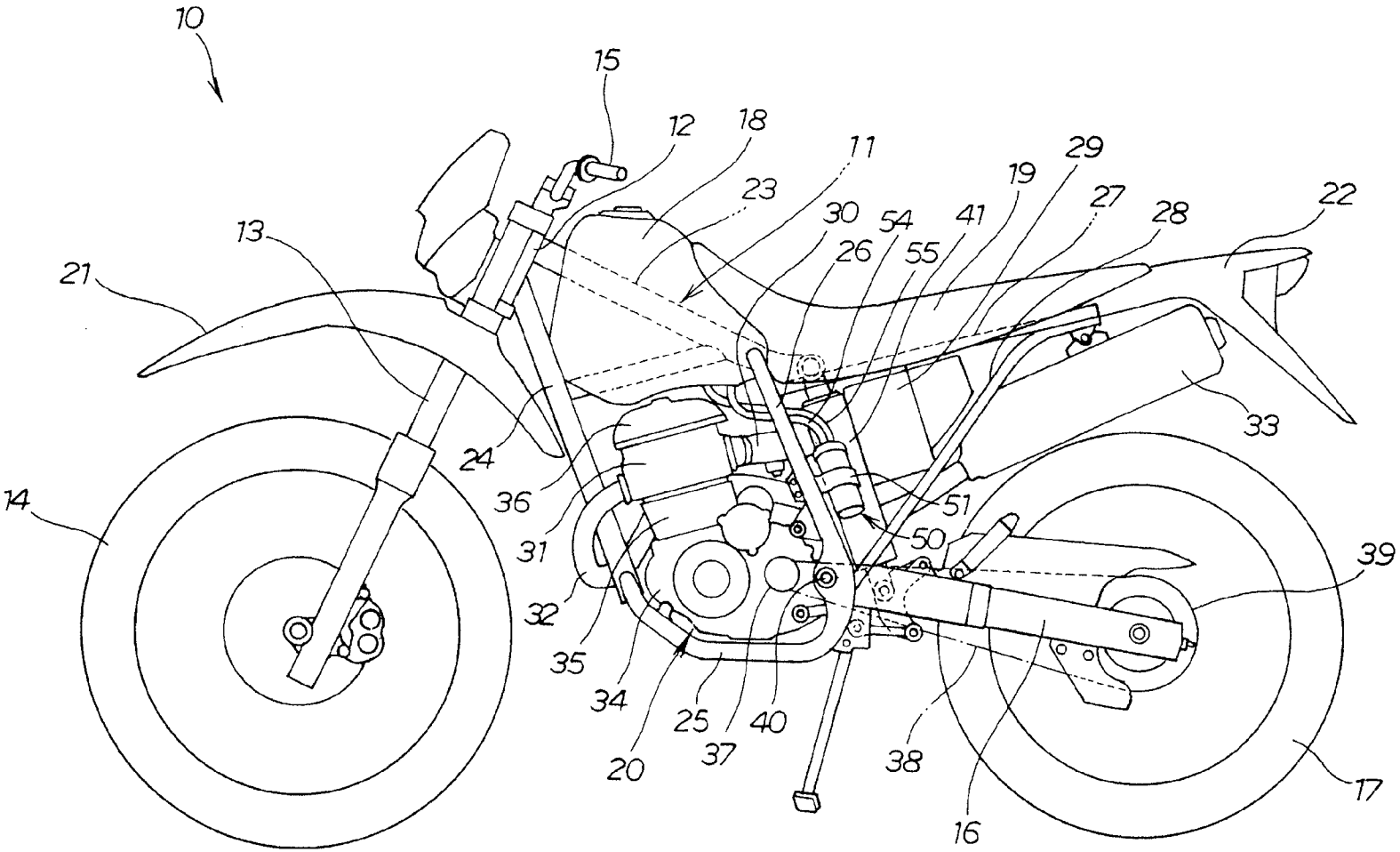
FIG. 1 is a left side elevational view of a motorcycle which includes a fuel pump apparatus of the present invention.

An embodiment of the present invention is described below with reference to the accompanying drawings. It is to be noted that the drawings should be viewed in the direction of reference characters. Further, forward, rearward, leftward and rightward directions represent directions as viewed from a driver seated on a seat.

Working Example 1

First, a Working Example 1 of the present invention is described with reference to the drawings.

As shown in FIG. 1, a motorcycle 10 is an off road bike wherein a front fork 13 is provided for steering operation on a head pipe 12 of a vehicle body frame 11; a front wheel 14 is attached for rotation at a lower portion of the front fork 13; a handle bar 15 is provided at an upper end of the front fork 13; a swing arm 16 extends rearwardly of the vehicle body from a rear lower portion of the vehicle body frame 11; a rear wheel 17 is attached for rotation at a rear end of the swing arm 16; a fuel tank 18 and a seat 19 for being seated by a rider are provided in this order on the vehicle body frame 11 rearwardly of the vehicle with respect to the head pipe 12; and an engine 20 is supported on the vehicle body frame 11 below the fuel tank 18.

A front fender 21 is attached to the front fork 13 such that it covers the front wheel 14 from above, and a rear fender 22 extends rearwardly of the vehicle from the seat 19 such that it covers the rear wheel 17 from above. The front fender 21 and the rear fender 22 prevent mud water from being scattered upwardly.

The vehicle body frame 11 includes the head pipe 12, a main frame 23 extending rearwardly downwards from the head pipe 12, a down frame 24 extending from the head pipe 12 below the main frame 23, a lower frame 25 extending rearwardly from a lower end portion of the down frame 24, a center frame 26 for connecting a rear end portion of the lower frame 25 and a rear end portion of the main frame 23 to each other, a rear frame 27 extending rearwardly from an upper portion of the center frame 26, and a sub frame 28 for connecting a lower end portion of the center frame 26 and a rear end portion of the rear frame 27 to each other.

An air cleaner 29 is disposed rearwardly of the vehicle with respect to the engine 20 below the seat 19, and an intake tube 30 extends forwardly of the vehicle from the air cleaner 29 and is connected to a cylinder head 31 of the engine 20.

Meanwhile, an exhaust tube 32 extends forwardly of the vehicle from the cylinder head 31. This exhaust tube 32 extends to the right side in the vehicle widthwise direction such that it extends downwardly in such a manner as to surround the down frame 24, and further extends rearwardly of the vehicle past the right side in the vehicle widthwise direction. A muffler 33 connected to a rear end of the exhaust tube 32 is disposed below the seat 19 but above the rear wheel 17 as viewed in side elevational of the vehicle.

The engine 20 includes a crankcase 34, a cylinder block 35 extending obliquely upwardly from the crankcase 34, the cylinder head 31 disposed on the cylinder block 35, and a head cover 36 disposed on the cylinder head 31.

The rear wheel 17 is driven by a driven sprocket wheel 39 rotated by a driving sprocket wheel 37 disposed in the crankcase 34 of the engine 20 through a chain 38.

The swing arm 16 which supports the rear wheel 17 is connected at an end thereof to a lower portion of the center frame 26 by a pivot shaft 40, and consequently, the rear wheel 17 can be moved upwardly and downwardly.

A rear suspension 41 is provided between the swing arm 16 and a rear portion of the main frame 23 (or a front portion of the rear frame 27), and the upward and downward movement of the swing arm 16 is controlled by the rear suspension 41.

A fuel pump apparatus 50 is disposed along the center frame 26. The fuel pump apparatus 50 is removably attached to the center frame 26 by a band-like bracket 51.

The fuel pump apparatus 50 sucks and pressurizes fuel in the fuel tank 18 and supplies the pressurized fuel to the fuel injector (FIG. 2, reference numeral 77) provided for the intake tube 30. Between the fuel pump apparatus 50 and the fuel tank 18, a fuel inflow hose 54 for causing fuel from the fuel tank 18 to flow into the fuel pump apparatus 50 and a return hose 55 for returning the fuel from the fuel pump apparatus 50 to the fuel tank 18 are piped.

Subsequently, the fuel pump apparatus 50 is described in detail.

Figure 2:
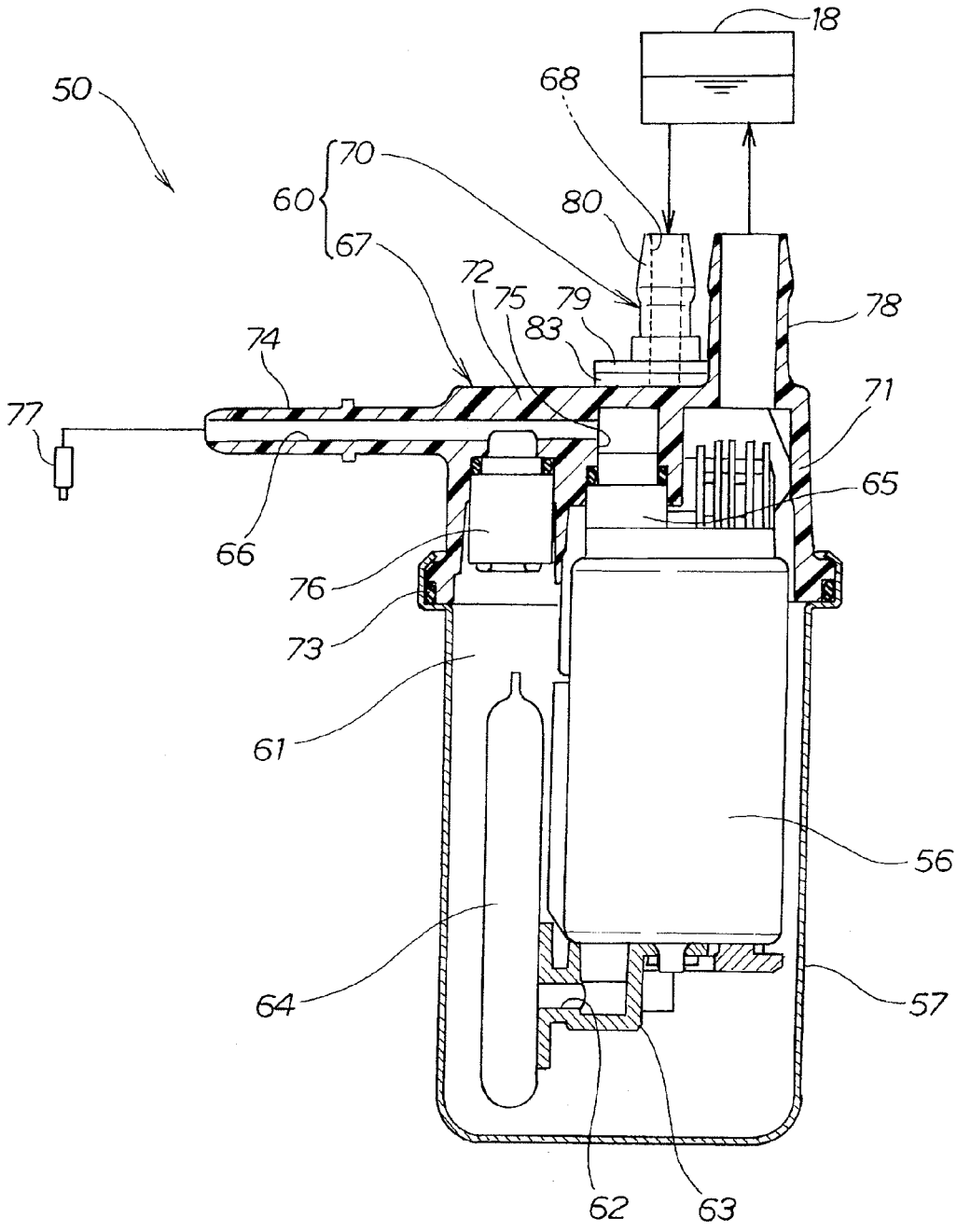
FIG. 2 is a sectional view of a fuel pump apparatus of a Working Example 1 according to the present invention.

As shown in FIG. 2, the fuel pump apparatus 50 includes a pump 56, a cylindrical tube member 57 for accommodating the pump 56 therein, and a lid member 60 for closing up an upper opening of the tube member 57. The internal space defined by the tube member 57 and the lid member 60 serves as a fuel chamber 61 for reserving fuel therein.

A support member 63 having a fuel intake path 62 is provided at a lower end of the pump 56, and a pump pre-filter 64 is supported on the support member 63. A discharge port portion 65 for discharging sucked fuel therethrough is provided at an upper end of the pump 56.

The lid member 60 is formed divisionally from a first lid member 67 attached to the tube member 57 and having a fuel supply path 66, and a second lid member 70 removably provided on the first lid member 67 and having a fuel inflow path 68.

The first lid member 67 is a molded article of synthetic resin formed from a cylindrical circumferential wall 71 and a disk-shaped upper wall 72 molded integrally with each other. The circumferential wall 71 is attached at a lower end portion thereof to an upper end portion of the tube member 57 by caulking with an O-snap ring 73 interposed therebetween. It is to be noted that the first lid member 67 may be removably attached to the tube member 57 such that the pump pre-filter 64 can be exchanged.

An outflow portion 74 projecting forwardly is formed at a front upper portion of the circumferential wall 71, and a recessed portion 75 in which the discharge port portion 65 is fitted is formed at a central portion of the upper wall 72. The fuel supply path 66 is formed to extend from the recessed portion 75 to an end of the outflow portion 74. Further, a check valve 76 having an upper end opposing to the fuel supply path 66 is assembled to the circumferential wall 71.

The outflow portion 74 is communicated with a fuel injector 77 through a hose member, and fuel discharged from the discharge port portion 65 passes through the fuel supply path 66 and is supplied to the fuel injector 77. Meanwhile, at a rear portion of the upper wall 72, a returning portion 78 which is provided projecting upwardly and connected to the return hose (FIG. 1, reference numeral 55) is provided.

The second lid member 70 is disposed on the first lid member 67. The second lid member 70 includes an attaching seat portion 79, and an inflow portion 80 provided at the center of the attaching seat portion 79 and projecting upwardly. The fuel inflow path 68 is formed so as to penetrate from an end of the inflow portion 80 to the attaching seat portion 79. Fuel from the fuel tank 18 flows into the fuel inflow path 68 through the fuel inflow hose (FIG. 1, reference numeral 54).

Figure 3:
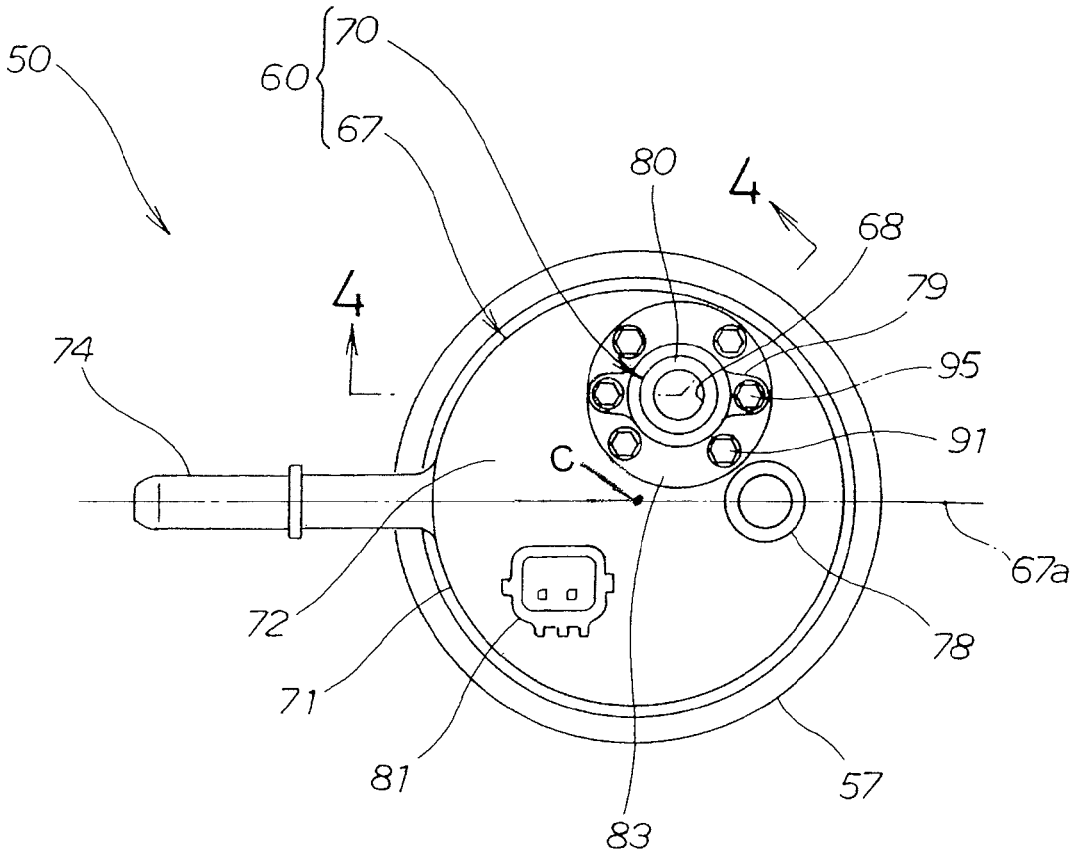
FIG. 3 is a plan view of the fuel pump apparatus of the Working Example 1.

As shown in FIG. 3, the outflow portion 74 and the returning portion 78 are disposed on a line 67*a* which passes the center C of the first lid member 67. Meanwhile, the second lid member 70 is disposed in an offset relationship to one side (on the upper side in the figure) of the line 67*a* which passes the center C. On the other side (on the lower side in the figure) of the line 67*a* which passes the center C, a connector 81 for supplying electric power to the pump is provided.

Figure 4:
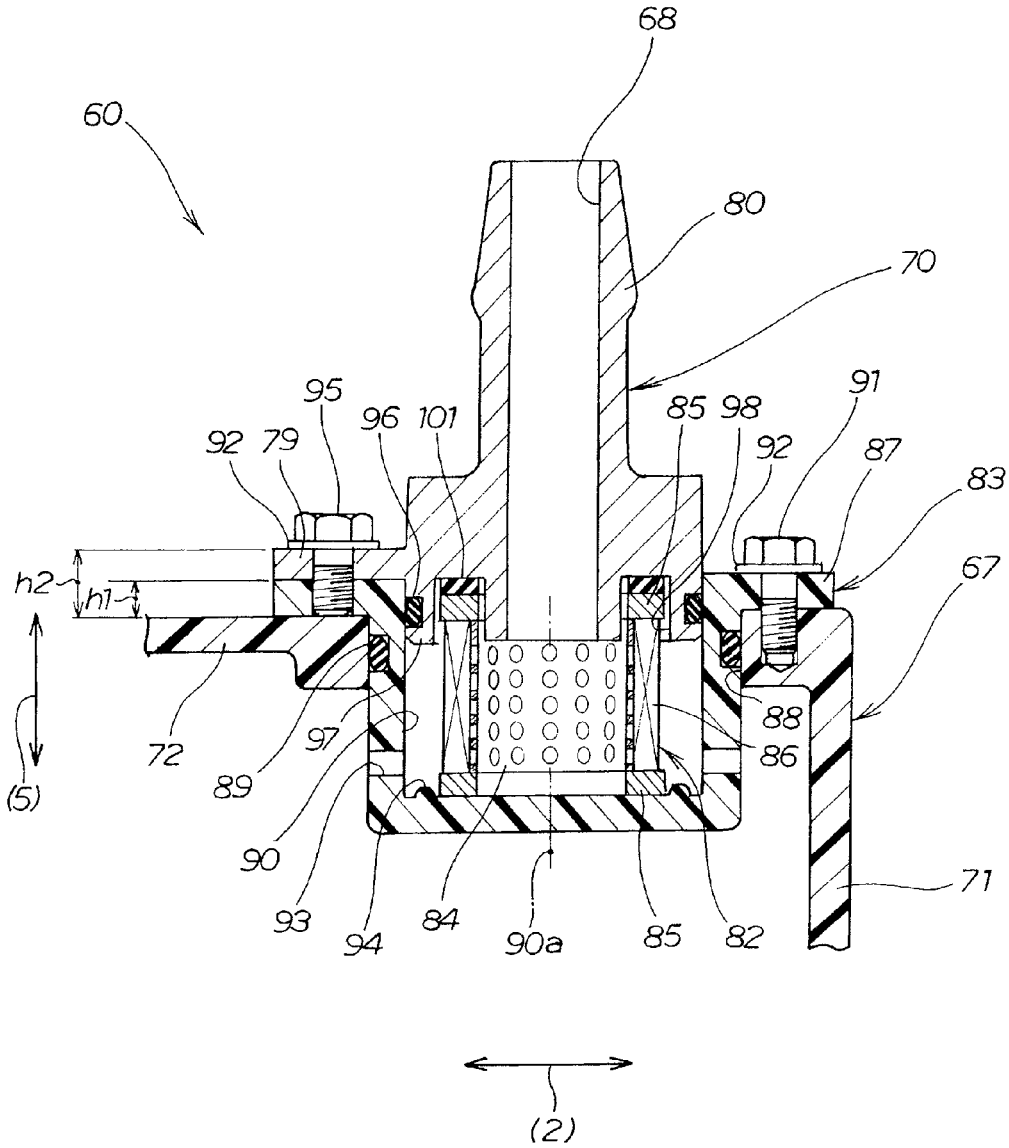
FIG. 4 is a sectional view taken along line 4-4 of FIG. 3.

A sectional view taken along line 4-4 of FIG. 3 is shown in FIG. 4.

As shown in FIG. 4, the first lid member 67 includes an inner lid 83, and a fuel filter 82 is accommodated in the inner lid 83. The fuel filter 82 includes a porous tube 84 serving as a winding core, end plates 85 individually secured to an upper end and a lower end of the porous tube 84, and a filter paper 86 in the form of a pleated sheet wound around the outer periphery of the porous tube 84.

The inner lid 83 includes a flange portion 87 placed on the upper wall 72, and a cylindrical accommodating recessed portion 90 fitted in an attaching hole 88 provided in the upper wall 72 with an O-snap ring 89 interposed therebetween. The flange portion 87 is fastened to the upper wall 72 by four first bolts 91 (refer to FIG. 3) and washers 92. A plurality of slit holes 93 juxtaposed in a circumferential direction are formed at a lower portion of the accommodating recessed portion 90.

A position restraining member 94 for restraining movement of the fuel filter 82 in a direction (arrow mark (2)) perpendicular to the axis of the fuel filter 82 is foamed integrally on a bottom wall of the accommodating recessed portion 90. The position restraining member 94 is an annular projection centered at the center axis 90*a* of the accommodating recessed portion 90. It is to be noted that the position restraining member 94 may be formed as a ring-shaped separate part fitted on the bottom wall of the accommodating recessed portion 90 and may have an arbitrary shape.

The second lid member 70 has an insertion portion 97 for being inserted into the accommodating recessed portion 90 of the inner lid 83 with an O-snap ring 96 interposed therebetween. An annular recessed portion 98 with which an upper portion of the fuel filter 82 is to be fitted is formed on a lower face of the insertion portion 97. The shape of the annular recessed portion 98 is determined in accordance with the shape of the upper portion of the fuel filter 82 (an outer diameter and an inner diameter of the end plates 85).

A pressing member 101 for restricting movement of the fuel filter 82 in its axial direction (arrow mark (5)) is interposed between the annular recessed portion 98 and one of the end plates 85. In particular, the pressing member 101 plays a roll of pressing the fuel filter 82 downwardly in a state in which the second lid member 70 is attached to the first lid member 67 to suppress movement of the fuel filter 82 in the axial direction (arrow mark (5)).

While the pressing member 101 is formed from an arbitrary material such as rubber or synthetic resin only if it can press the fuel filter 82 in the axial direction (arrow mark (5)), preferably a sheet packing having sealability and elasticity is used.

Further, in the case where the pressing member 101 is exchanged together with the fuel filter 82, it is preferably attached to the fuel filter 82 (end plates 85) or incorporated as a single item without being attached to another part, it may be attached to the second lid member 70 (annular recessed portion 98).

Here, a flow of fuel around the fuel filter is described.

Figure 5:
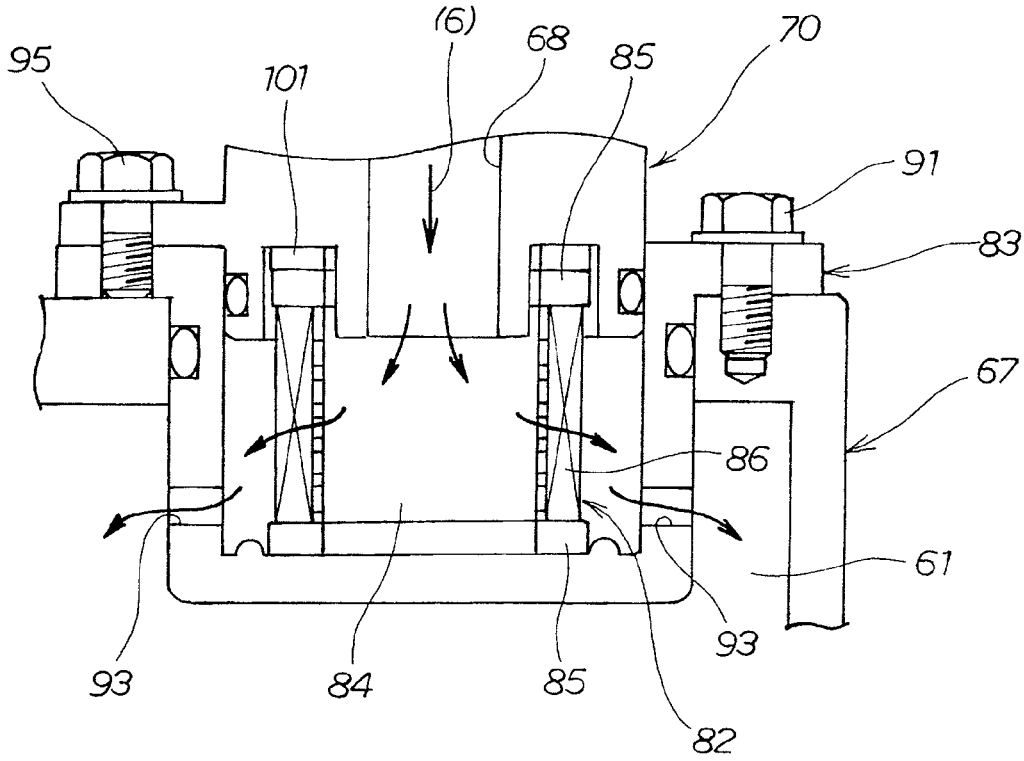
FIG. 5 is a view illustrating working of a fuel filter.

As shown in FIG. 5, fuel from the fuel tank flows into the fuel inflow path 68 as indicated by an arrow mark (6). The fuel flowed in passes the porous tube 84 of the fuel filter 82 and passes through the filter paper 86, whereupon foreign matter is removed. The fuel passing through the filter paper 86 flows down into the fuel chamber 61 through the slit holes 93 and is then pressure-fed to the fuel injector (FIG. 2, reference numeral 77) past the pump pre-filter (FIG. 2, reference numeral 64), pump (FIG. 2, reference numeral 56) and fuel supply path (FIG. 2, reference numeral 66).

Since foreign matter included in the fuel is removed in advance by the fuel filter 82, the burden on the pump pre-filter is reduced and clogging of the pump pre-filter can be prevented.

Working effects of the fuel pump apparatus 50 described above are described.

The fuel filter 82 is accommodated into the inner lid 83 and the inner lid 83 is closed up with the second lid member 70 to build the fuel filter 82 into the lid member 60.

Since the fuel filter 82 is built in the lid member 60, the requirement for a protective case for protecting the fuel filter and a stay for attaching the fuel filter to the vehicle body is eliminated. Since the protective case and the stay are not required, the number of parts can be reduced to achieve reduction of the cost in comparison with a structure wherein the fuel filter is interposed between the fuel tank and the fuel pump apparatus.

Further, since the fuel filter 82 can be taken out only by loosening second bolts 95 and removing the second lid member 70, there is no requirement for removal of the first lid member 67 from the tube member 57, and exchange of the fuel filter 82 is facilitated.

Further, the fuel filter 82 is positioned to a predetermined place of the first lid member 67 (on the center axis 90*a* of the accommodating recessed portion) by the position restraining member 94. Since the fuel filter 82 is positioned, when the second lid member 70 is to be attached to the inner lid 83, an upper portion of the fuel filter 82 can be fitted accurately into the annular recessed portion 98. Since the fuel filter 82 is fitted accurately in the annular recessed portion 98, the second lid member 70 can be attached to the inner lid 83 readily.

As a result, exchange of the fuel filter 82 is further facilitated. If it is assumed that the position restraining member 94 does not exist, then since the position of the fuel filter 82 is displaced in the accommodating recessed portion 90, the end plates 85 of the fuel filter 82 may possibly interfere with the insertion portion 97 to make attachment of the second lid member 70 less easy.

Further, since the position restraining member 94 is molded integrally with the inner lid 83, there is no requirement for new addition of a part for position restriction, and reduction of the number of parts can be anticipated.

Furthermore, in a state in which the second lid member 70 is attached to the inner lid 83, since the pressing member 101 presses the fuel filter 82 downwardly to suppress movement of the fuel filter 82 in the axial direction (arrow mark (5)), the fuel filter 82 is held with certainty between the inner lid 83 and the second lid member 70. Therefore, vibration of the fuel filter 82 can be suppressed.

Figure 6:
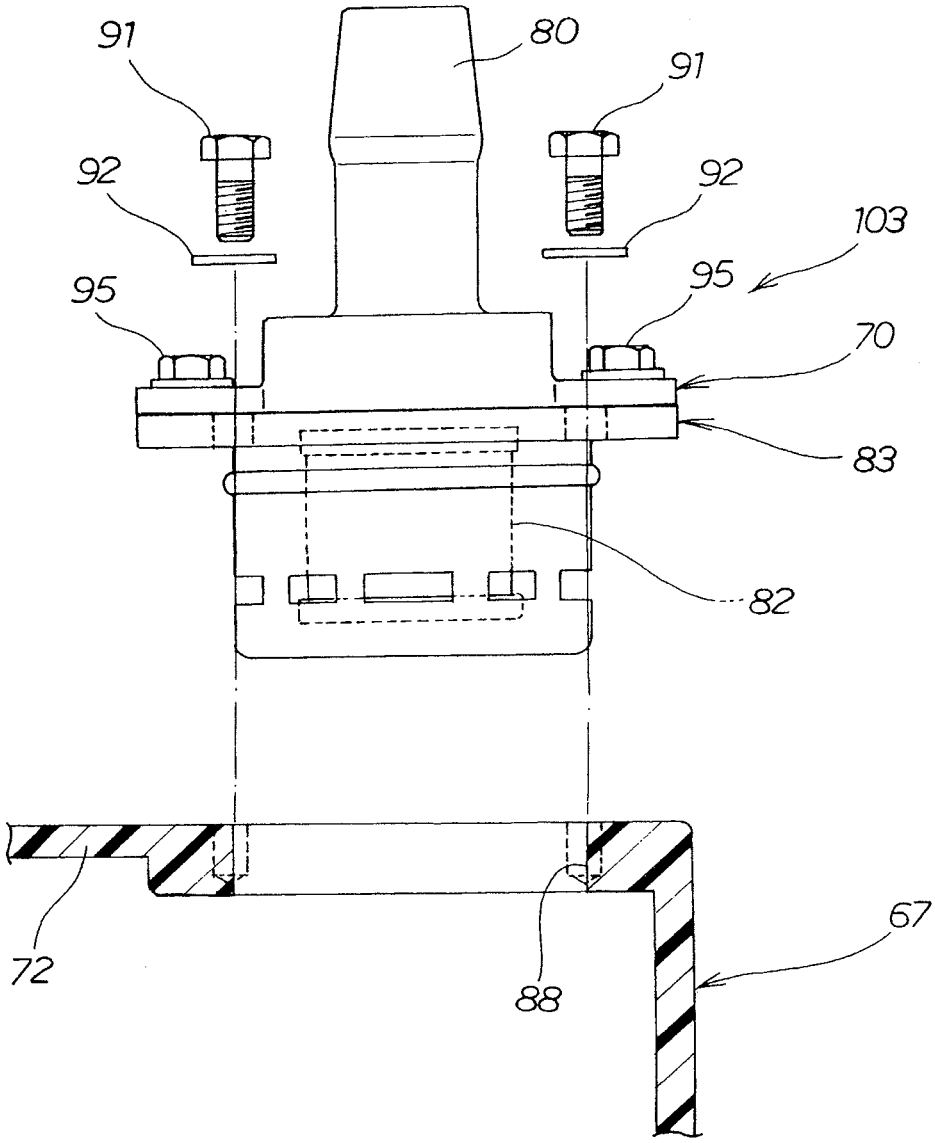
FIG. 6 is a view illustrating a removing procedure of a filter case.

Further, working illustrated in FIG. 6 is exhibited.

Since the inner lid 83 is removably provided on the first lid member 67, by removing only the first bolts 91, the inner lid 83 and the second lid member 70 can be removed as a single filter case 103 as shown in FIG. 6.

Under an environment in which much dust exists and it is not desirable to take out the fuel filter 82 at the site, it is possible to remove only the first bolts 91 and move the filter case 103 to a clean place and then remove the second lid member 70 and clean or exchange the fuel filter 82.

Now, modifications to the Working Example 1 are described with reference to the drawings.

Figure 7:
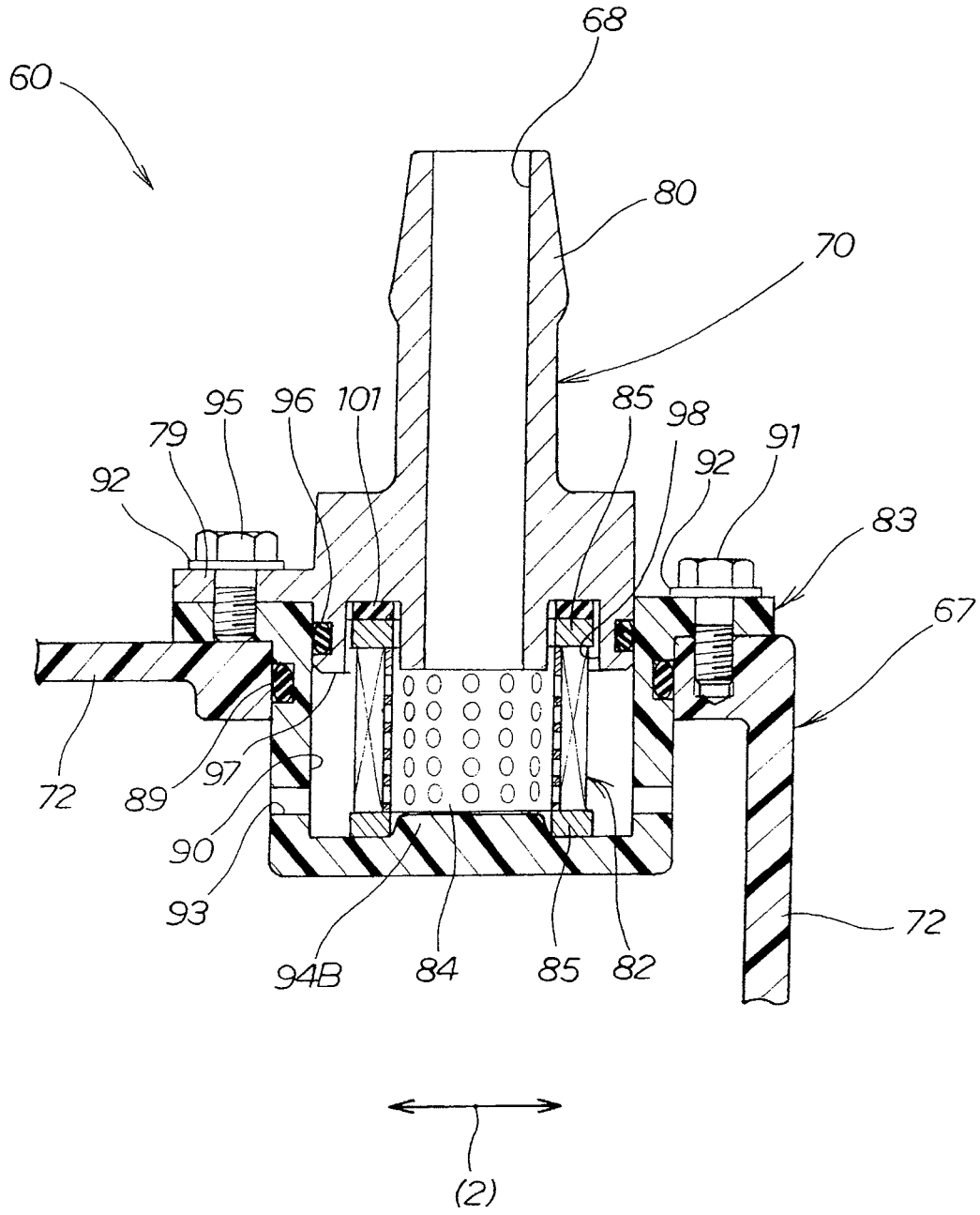
FIG. 7 is a view showing an example of a modification to the fuel pump apparatus of FIG. 4.

FIG. 7 is a view showing an example of a modification to the fuel pump apparatus of FIG. 4. The difference of the modification from the fuel pump apparatus of FIG. 4 resides in that a position restraining member 94B is projected to the inner side of the fuel filter 82. Since the other part is same as that of FIG. 4, reference characters of FIG. 4 are diverted and detailed description is omitted (this similarly applies also to a different modification, a Working Example 2 and a Working Example 3 hereinafter described).

The position restraining member 94B is a cylindrical projection projecting to the inner side of the end plates 85 of the fuel filter 82 and is molded integrally with the inner lid 83. Also with the present modification, since the fuel filter 82 is positioned similarly as in the case of the position restraining member 94 shown in FIG. 4, the second lid member 70 can be attached to the inner lid 83 readily.

Subsequently, a different modification is described with reference to the drawings.

Figure 8:
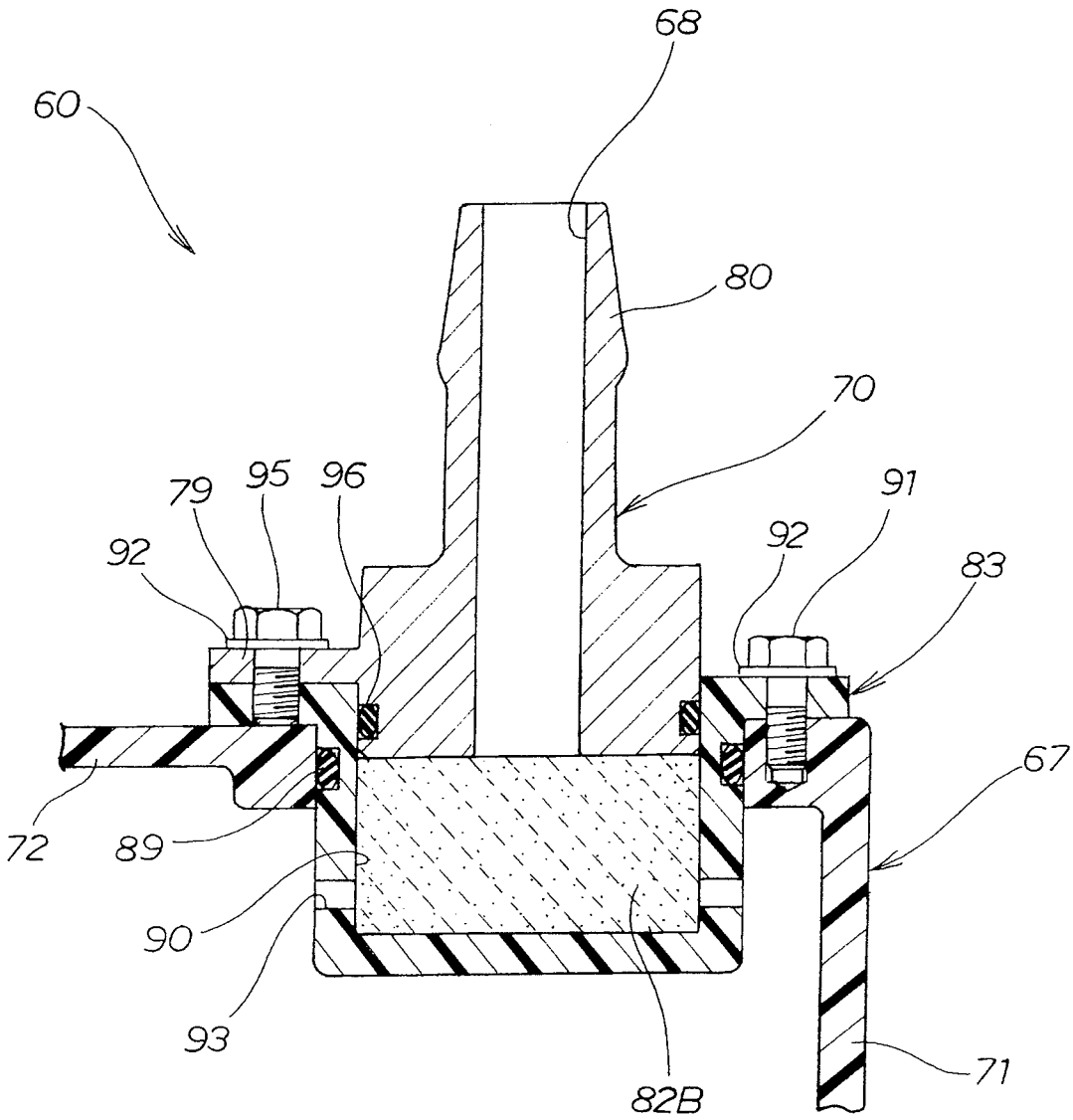
FIG. 8 is a view showing a different example of a modification to the fuel pump apparatus of FIG. 4.

FIG. 8 is a view showing a different modification to the fuel pump apparatus of FIG. 4. The difference of the modification from the fuel pump apparatus of FIG. 4 resides in that a fuel filter 82B is formed as a sponge filter. The annular recessed portion (FIG. 4, reference numeral 98) is not formed on the second lid member 70, and the lower face of the second lid member 70 is flat. Further, also the bottom wall of the inner lid 83 does not have the position restraining member (FIG. 4, reference numeral 94) but is flat.

The fuel filter 82B has a form (for example, a form of a circular cylinder) wherein it is filled in a space defined by the lower face of the second lid member 70 and the accommodating recessed portion 90. In the present modification, since the annular recessed portion is not required, the material cost and the working cost can be suppressed. Further, since there is no requirement for positioning of the fuel filter 82B, exchange of the fuel filter 82B is facilitated. Furthermore, since the sponge filter can be cleaned readily, there is an effect also that it is easy to re-use.

It is to be noted that the modification and the different modification to the Working Example 1 can be applied also to a Working Example 2 and so forth.

Working Example 2

Now, a Working Example 2 of the present invention is described with reference to the drawings.

Figure 9:
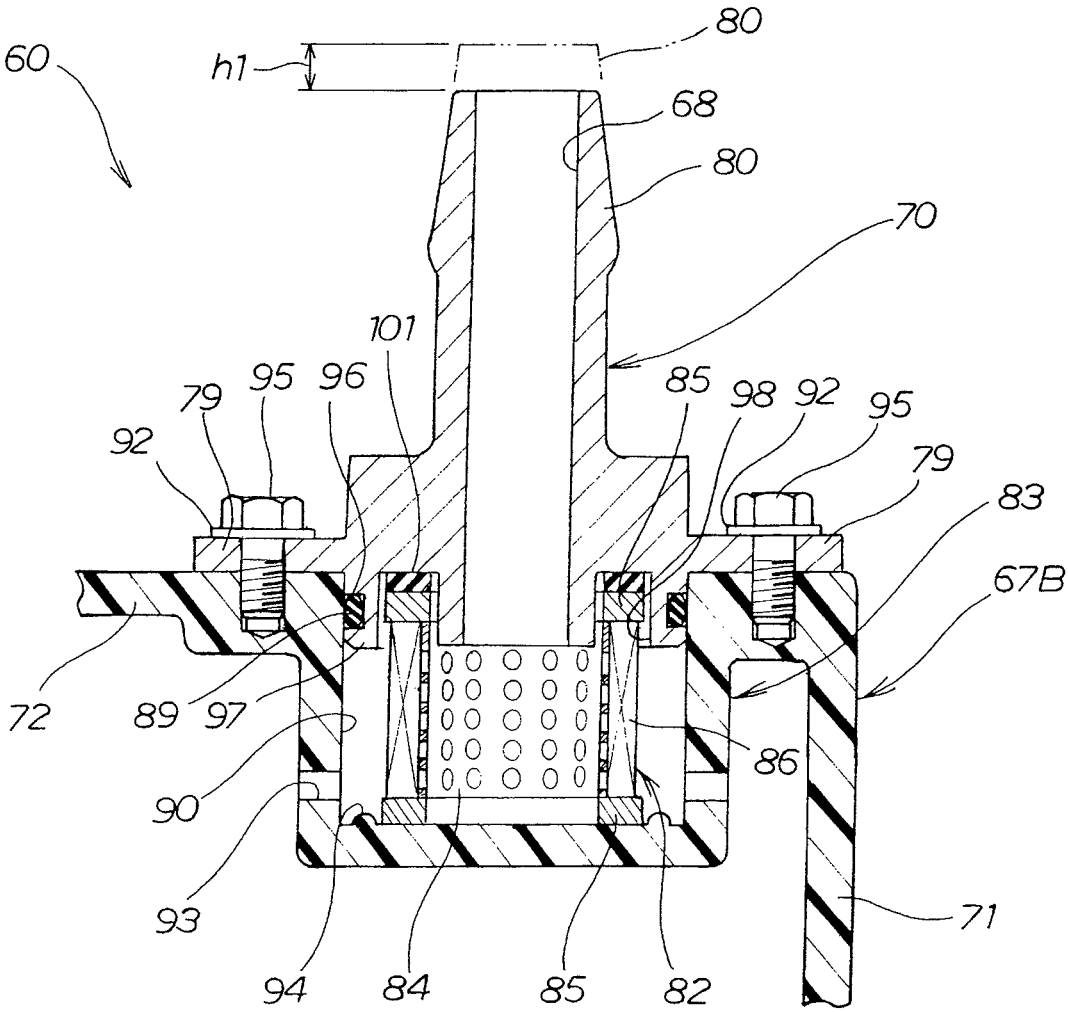
FIG. 9 is a partial sectional view of a lid member according to a Working Example 2.

As shown in FIG. 9, the Working Example 2 is an example wherein the inner lid (FIG. 4, reference numeral 83) described in the description of the Working Example 1 is molded integrally in a molding process of a first lid member 67B, and the accommodating recessed portion 90 is shaped such that the upper wall 72 of the first lid member 67B is recessed. With the Working Example 2, since the height of the second lid member 70 can be made lower by an amount corresponding to the height (FIG. 4, reference character h1) of the flange portion of the inner lid, miniaturization of the fuel pump apparatus can be anticipated. Further, the inner lid (FIG. 4, reference numeral 83) and the first bolts (FIG. 4, reference numeral 91) become unnecessary, and also it is possible to achieve reduction of the cost.

Working Example 3

Now, a Working Example 3 of the present invention is described with reference to the drawings.

Figure 10:
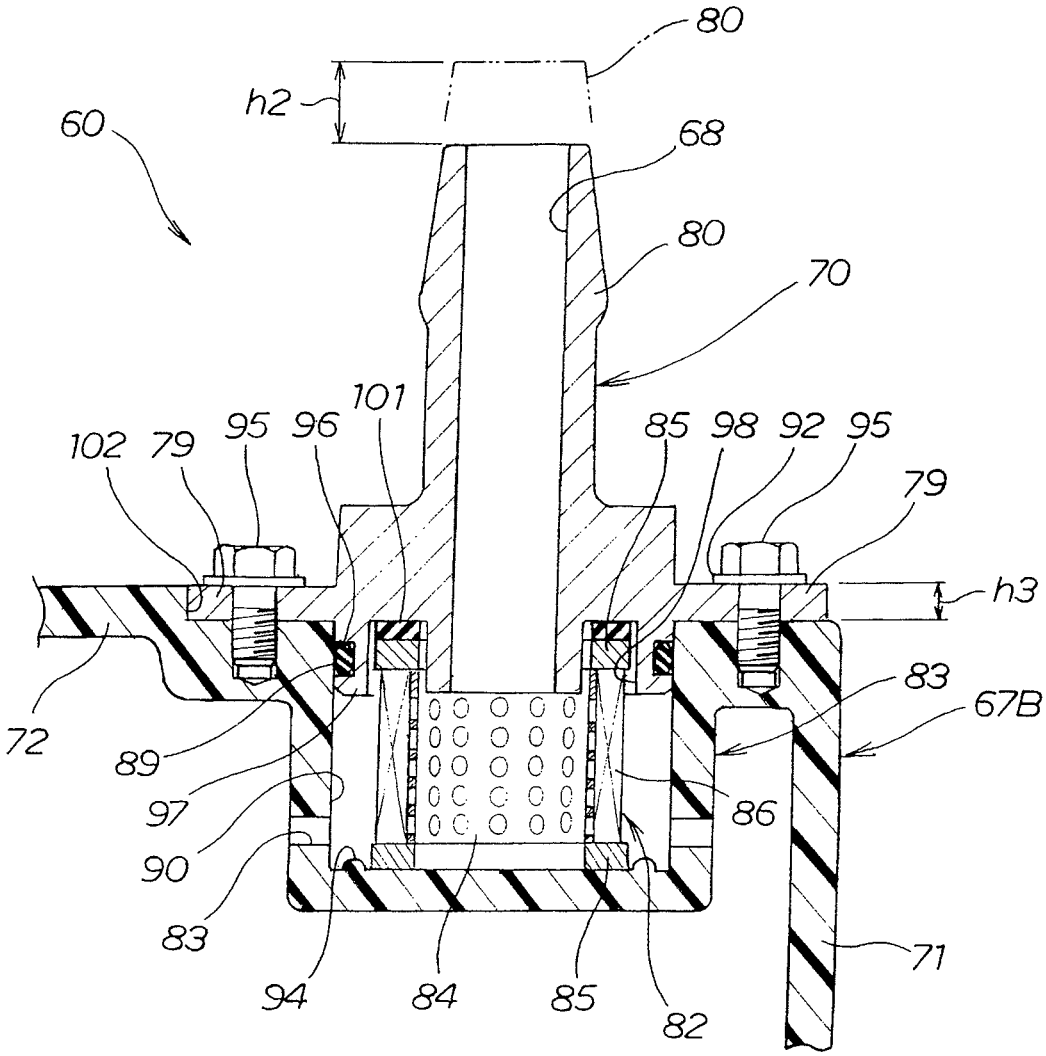
FIG. 10 is a partial sectional view of a lid member according to a Working Example 3.

As shown in FIG. 10, the Working Example 3 is configured such that, in the configuration of the Working Example 2, an offset 102 corresponding to a height h3 of the attaching seat portion 79 of the second lid member 70 is formed on the upper wall 72 and the second lid member 70 is fastened to a lower stage face of the offset 102 by means of the second bolts 95. With the Working Example 3, since the height of the second lid member 70 can be reduced by an amount corresponding to the height (FIG. 4, reference character h2) which is the sum of the height (FIG. 4, reference character h1) of the flange portion 87 of the inner lid 83 and the height of the attaching seat portion 79, the fuel pump apparatus can be further miniaturized.

It is to be noted that, although the fuel pump apparatus of the present invention is suitable for an off road bike, it may be applied to other motorcycles. Further, the fuel pump apparatus of the present invention may be mounted on an irregular ground traveling vehicle called four-wheel buggy.

Further, while the present invention is applied to an example wherein preferably a fuel pump is disposed independently at a place different from a fuel tank is described, it is possible to adopt the present invention also in a fuel pump apparatus wherein the fuel pump apparatus is disposed in the fuel tank.

The fuel pump apparatus of the present invention is suitable for an off road bike. Further, the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel pump apparatus comprising:

a pump, a tube member for accommodating said pump, and a lid member for closing up an upper opening of said tube member, wherein fuel supplied from a fuel tank and reserved in said tube member is sucked into and pressurized by said pump and supplied to an engine, wherein a fuel filter is provided for removing foreign matter included in the fuel from the fuel tank, wherein said lid member includes:

a first lid member having a fuel supply path for supplying the fuel pressurized by said pump to said engine, an inner lid removably attached to an upper surface of the first lid member so as to be positioned in the fuel supply path, and a second lid member having a fuel inflow path for introducing the fuel from said fuel tank into said tube member, wherein the first lid member is attached to the tube member, and the second lid member is removably attached to an upper surface of the inner lid, and wherein the fuel filter is accommodated inside the inner lid, and an upper surface of the fuel filter is covered by the second lid member.

2. The fuel pump apparatus according to claim 1, wherein the second lid member and the inner lid constitute a unit removably attached to the first lid member by bolts which extend through the second lid member, the inner lid, and into the first lid member, and the unit is removable from the first lid member.

3. The fuel pump apparatus according to claim 2, wherein said first lid member includes a position restraining member provided thereon for restraining movement of said fuel filter in a direction perpendicular to an axial direction thereof.

4. The fuel pump apparatus according to claim 3, wherein said position restraining member is molded integrally with said first lid member.

5. The fuel pump apparatus according to claim 2, wherein a pressing member for restraining movement of said fuel filter in the axial direction is interposed between said second lid member and said fuel filter.

6. The fuel pump apparatus according to claim 3, wherein a pressing member for restraining movement of said fuel filter in the axial direction is interposed between said second lid member and said fuel filter.

7. The fuel pump apparatus according to claim 1, wherein the inner lid includes:

a cylindrical accommodating recessed portion, a flange portion surrounding an upper edge of the cylindrical accommodating recessed portion, and a plurality of slit holes juxtaposed in a circumferential direction formed at a lower portion of the accommodating recessed portion.

8. The fuel pump apparatus according to claim 2, wherein the first lid member includes an outflow portion and a returning portion, and when a top side of the first lid member is viewed in plan view, the outflow portion and a returning portion are seen as being disposed on a line which passes through a center (C) of the first lid member, wherein the second lid member is disposed in an offset relationship to one side of the line which passes the center (C) of the first lid member.

9. The fuel pump apparatus according to claim 8, wherein the outflow portion and the returning portion have axes which extend in directions that are substantially perpendicular to each other.

10. The fuel pump apparatus according to claim 1, wherein the second lid member is removably attached to the inner lid by bolts extending through the second lid member and which are fastened only to the inner lid.

11. A fuel pump apparatus comprising:

a pump, a tube member for accommodating said pump, and a lid member for closing up an upper opening of said tube member, wherein fuel supplied from a fuel tank and reserved in said tube member is sucked into and pressurized by said pump and supplied to an engine, wherein said lid member includes a fuel inflow path for introducing the fuel from said fuel tank into said tube member and a fuel supply path for supplying the fuel pressurized by said pump to said engine, and wherein a fuel filter for removing foreign matter included in the fuel from said fuel tank is removably provided for said fuel supply path, wherein the lid member includes:

a first lid member including:

a disk-shaped upper wall and cylindrical circumferential wall which are formed integrally with each other, and the circumferential wall is snap fitted at a lower end portion thereof to an upper end portion of the tube member, the fuel supply path, and a cylindrical accommodating recessed portion in the fuel supply path for accommodating the fuel filter, and a second lid portion including:

the fuel inflow path, wherein the second lid member is removably attached to an upward facing a horizontal surface of the first lid member, and an upper surface of the fuel filter is covered by the second lid member.

12. The fuel pump apparatus according to claim 11, wherein the second lid member is formed with a circumferential flange, and the circumferential seat portion of the second lid member is inset into an upper wall of the first lid member, so that upper surfaces of the upper wall of the first lid member and the seat portion of the second lid member are co-planar.

13. The fuel pump apparatus according to claim 11, wherein said first lid member includes a position restraining member provided thereon for restraining movement of said fuel filter in a direction perpendicular to an axial direction thereof.

14. The fuel pump apparatus according to claim 13, wherein said position restraining member is molded integrally with said first lid member.

15. The fuel pump apparatus according to claim 12, wherein a pressing member for restraining movement of said fuel filter in the axial direction is interposed between said second lid member and said fuel filter.

16. The fuel pump apparatus according to claim 11, wherein the first lid member includes an outflow portion and a returning portion, and when the disk-shaped upper wall of the first lid member is viewed in plan view, the outflow portion and a returning portion are seen as being disposed on a line which passes through a center (C) of the first lid member, wherein the second lid member is disposed in an offset relationship to one side of the line which passes the center (C) of the first lid member.

17. The fuel pump apparatus according to claim 16, wherein the outflow portion and the returning portion have axes which extend in directions that are substantially perpendicular to each other.

18. A fuel pump apparatus comprising:

a pump, a tube member for accommodating said pump, and a lid member for closing up an upper opening of said tube member, wherein fuel supplied from a fuel tank and reserved in said tube member is sucked into and pressurized by said pump and supplied to an engine, wherein the lid member includes:

a first lid member having a fuel supply path for supplying the fuel pressurized by said pump to said engine, an inner lid removably attached to an upper surface of the first lid member so as to be positioned in the fuel supply path, and a second lid member having a fuel inflow path for introducing the fuel from said fuel tank into said tube member, and wherein the first lid member is attached to the tube member, and the second lid member is removably attached to an upper surface of the inner lid, and and provided, and further comprising:

a fuel filter for removing foreign matter included in the fuel from said fuel tank is removably and accommodated inside the inner lid, and an upper surface of the fuel filter is covered by the second lid member, a support member having a fuel intake path provided at a lower end of the pump, and a pump pre-filter supported on the support member.

19. The fuel pump apparatus according to claim 18, wherein the second lid member and the inner lid constitute a unit removably attached to the first lid member by bolts extending through the second lid member, the inner lid, and into the first lid member, and the unit is removable from the first lid member when the bolts are unfastened from the first lid member.

* * * * *